United States Patent [19]

Merkli et al.

[11] Patent Number: 4,708,561

[45] Date of Patent: Nov. 24, 1987

[54] APPARATUS FOR ACCUMULATING AND TRANSPORTING STACKS OF PAPER SHEETS AND THE LIKE

[75] Inventors: Peter Merkli; Daniel Jermann, both of Oftringen, Switzerland

[73] Assignee: Grapha-Holding AG, Hergiswil, Switzerland

[21] Appl. No.: 782,683

[22] Filed: Oct. 1, 1985

[30] Foreign Application Priority Data

Oct. 1, 1984 [CH] Switzerland ..... 4705/84

[51] Int. Cl.[4] ..... B42C 5/00; B65G 57/22; B65G 25/02; B65H 29/00

[52] U.S. Cl. ..... 412/25; 414/31; 414/46; 198/740

[58] Field of Search ..... 412/25; 414/31, 46, 414/65, 78; 271/273, 215; 198/740

[56] References Cited

U.S. PATENT DOCUMENTS 3,379,320 4/1968 Loach et al. ..... 414/46
3,585,909 6/1971 Carrel ..... 414/46
4,068,567 1/1978 Allison et al. ..... 414/31
4,421,221 12/1983 Pessina et al. ..... 414/31
4,457,656 7/1984 Kosina et al. ..... 414/31
4,524,860 6/1985 Misawa ..... 198/740

*Primary Examiner*—Frank T. Yost
*Assistant Examiner*—Paul M. Heyrana, Sr.
*Attorney, Agent, or Firm*—Peter K. Kontler

[57] ABSTRACT

Successive stacks of signatures which are accumulated on a turntable are transferred onto a first or onto a second removing conveyor by a pusher which is reciprocable by a carriage along a straight guide rail and is pivotable relative to the carriage so that its ejector bypasses the turntable during movement in a first direction in which it normally transfers stacks from the turntable onto the first removing conveyor or in a seond direction in which it normally transfers stacks from the turntable onto the second removing conveyor. The pusher is pivotable relative to its carriage by a follower which is mounted thereon and extends into a composite groove defined in part by a stationary cam and in part by a pivotable cam.

19 Claims, 2 Drawing Figures

I
II
1
2
3
4
5
6
6'
7
8
9
10
11
12
13
14
15
15'
15''
16
16a
16b
17
18
19
20
21
22
23
24
25
26
27
29
30
50

APPARATUS FOR ACCUMULATING AND TRANSPORTING STACKS OF PAPER SHEETS AND THE LIKE

BACKGROUND OF THE INVENTION

The present invention relates to apparatus for accumulating and transporting stacks of paper sheets and the like. More particularly, the invention relates to improvements in apparatus for transporting sheet-like commodities, especially stacks of overlapping paper sheets, which are accumulated on a support and are to be transferred onto conveyor means for delivery to a further processing station, for example, to a hoop-casing machine which provides the stacks with straps to ensure that the constituents of the stacks cannot be shifted relative to each other.

Swiss Pat. No. 496,574 discloses an apparatus wherein stacks are accumulated on a support and can be transferred from the support onto a conveyor by a vertically extending rod-like pusher which is reciprocable by a pneumatic cylinder and piston unit along a predetermined path a portion of which extends across the support and which terminates sufficiently close to the conveyor so that the latter can accept and advance a stack which has been delivered thereto by the oncoming pusher. A drawback of the patented apparatus is that each portion of the pusher invariably remains in its path so that it moves across the space wherein the support accumulates successive stacks during movement toward as well as during movement away from the conveyor. This prevents the support from beginning with the accumulation of a fresh stack already during return movement of the pusher to its starting position preparatory to transfer of a freshly gathered stack from the support onto the conveyor. In fact, the piston rod of the cylinder and piston unit which is used to reciprocate the pusher extends across the support (such as a table) at all times except when the pusher has reassumed its starting position.

OBJECTS AND SUMMARY OF THE INVENTION

An object of the invention is to provide a novel and improved apparatus which can transfer successive stacks or like accumulations of paper sheets or the like at a frequency which is much higher than those achievable in conventional apparatus.

Another object of the invention is to provide an apparatus wherein the support can begin to accumulate a fresh stack during transport of the pusher back to its starting position.

A further object of the invention is to provide an apparatus wherein the pusher can selectively deliver stacks or like accumulations of overlapping sheets to any one of several stack removing conveyors.

Still another object of the invention is to provide the apparatus with novel and improved means for controlling the movements and the position of the pusher during its forward as well as during its return strokes.

A further object of the invention is to provide the apparatus with novel and improved means for selectively diverting a portion of the pusher from its normal path so as to enable the pusher to proceed with the transfer of stacks or like accumulations of sheets to a different removing conveyor.

Another object of the invention is to provide the apparatus with novel and improved means for distributing successively gathered or delivered commodities in the form of stacked paper sheets or the like to any one of several receiving stations.

An additional object of the invention is to provide a novel and improved method of manipulating stacks of paper sheets or the like, particularly preparatory to delivery of such stacks to a hoop-casing machine or the like.

One feature of the invention resides in the provision of an apparatus for manipulating sheet-like commodities, particularly for manipulating stacks of paper sheets. The apparatus comprises a support (for example, a turntable which can be indexed about a vertical axis), means for delivering to the support a succession of commodities (such delivery means can comprise a pair of gates or doors which can accumulate and dump partial or complete stacks of paper sheets onto the support), a conveyor which is adjacent to the support, a pusher which serves to transfer commodities from the support to the conveyor, means for reciprocating the pusher between first and second positions along a predetermined path wherein the pusher advances from the first to the second position to transfer a commodity from the support onto the conveyor, and means for diverting the pusher during advancement of the pusher from the second toward the first position so that the pusher bypasses the support. This renders it possible to gather a fresh stack on the support while the pusher moves from its second toward its first position.

The reciprocating means preferably includes an elongated guide, a carriage which is reciprocable along the guide, means for moving the carriage relative to the guide (such moving means can comprise a double-acting hydraulic or pneumatic cylinder and piston unit), and means for pivotably securing the pusher to the carriage. The diverting means preferably comprises means for pivoting the pusher relative to the carriage. Such pivoting means can comprise a follower which is provided on the pusher and stationary cam means tracked by the follower.

The apparatus preferably further comprises means for varying the effective length of the path. Such varying means can comprise a screw which can be rotated so that the tip of its shank moves into one end portion of the path and determines the extent of movement of the pusher toward the respective position.

Another feature of the invention resides in the provision of an apparatus for manipulating sheet-like commodities, particularly for manipulating stacks of paper sheets. The apparatus comprises a support, means for delivering to the support a succession of commodities, first and second conveyors which are disposed at the opposite sides of the support, a pusher which serves to transfer commodities from the support to a selected conveyor, means for reciprocating the pusher between first and second positions along a predetermined path wherein the pusher advances from the first toward the second position to transfer a commodity from the support onto the first conveyor and from the second toward the first position to transfer a commodity from the support onto the second conveyor, and means for selectively diverting the pusher during advancement from at least one of the two positions toward the other position so that the pusher bypasses the support.

The pusher is formed with a first surface which engages and moves a commodity during movement of the pusher from the first toward the second position, and with a second surface which engages and moves a commodity during movement of the pusher from the second toward the first position.

The diverting means preferably comprises means for diverting the pusher during advancement from the first toward the second position or vice versa. In other words, the pusher can bypass the support while it advances from the first toward the second position or it can be caused to bypass the support during advancement from the second toward the first position.

The reciprocating means preferably comprises an elongated guide, a carriage or slide which is reciprocable along the guide, means for moving the carriage relative to the guide, and means for pivotably securing the pusher to the carriage. The diverting means of such apparatus preferably comprises means for pivoting the pusher relative to the carriage. The path is or can be an elongated straight path, and the securing means preferably defines for the pusher a pivot axis which is substantially normal to the elongated straight path. The path is or can be substantially horizontal, and the axis which is defined for the pusher is preferably a substantially vertical axis.

The pivoting means can comprise a follower which is provided on the pusher and cam means which is tracked by the follower. The cam means can include a first section which is tracked by the follower while the pusher advances along the elongated path without bypassing the support, and a second section which is engaged by the follower while the pusher is diverted so that it bypasses the support. The diverting means preferably further comprises switchover means which is operable to engage the follower with the second section of the cam means after the follower completes its advancement toward the one position. The two sections of the cam means have neighboring first and neighboring second end portions, and the switchover means can include a device for transferring the follower from engagement with the first end portion of the first section into engagement with the first end portion of the second section of the cam means or vice versa. Such switchover device can comprise second cam means having a third cam section and means for moving the second cam means between a first position in which the third section registers with the first end portion of the first section and a second position in which the third section registers with the first end portion of the second section of the first-mentioned cam means. The switchover means can further comprise a guide (for example, a pivotable tongue) and means (such as an electromagnet) for moving the guide between a first position in which the follower is free to move only from the second end portion of the first section toward engagement with the second end portion of the second section, and a second position in which the follower can move only from the second end portion of the second section toward engagement with the second end portion of the first section. The electromagnet can be energized to maintain the guide in one of its positions.

The apparatus preferably further comprises means for varying the effective length of the elongated path. The varying means can comprise a stop (such as the aforementioned screw) which is movable into and relative to one end of the elongated path to thereby determine the respective position of the pusher.

The novel features which are considered as characteristic of the invention are set forth in particular in the appended claims. The improved apparatus itself, however both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
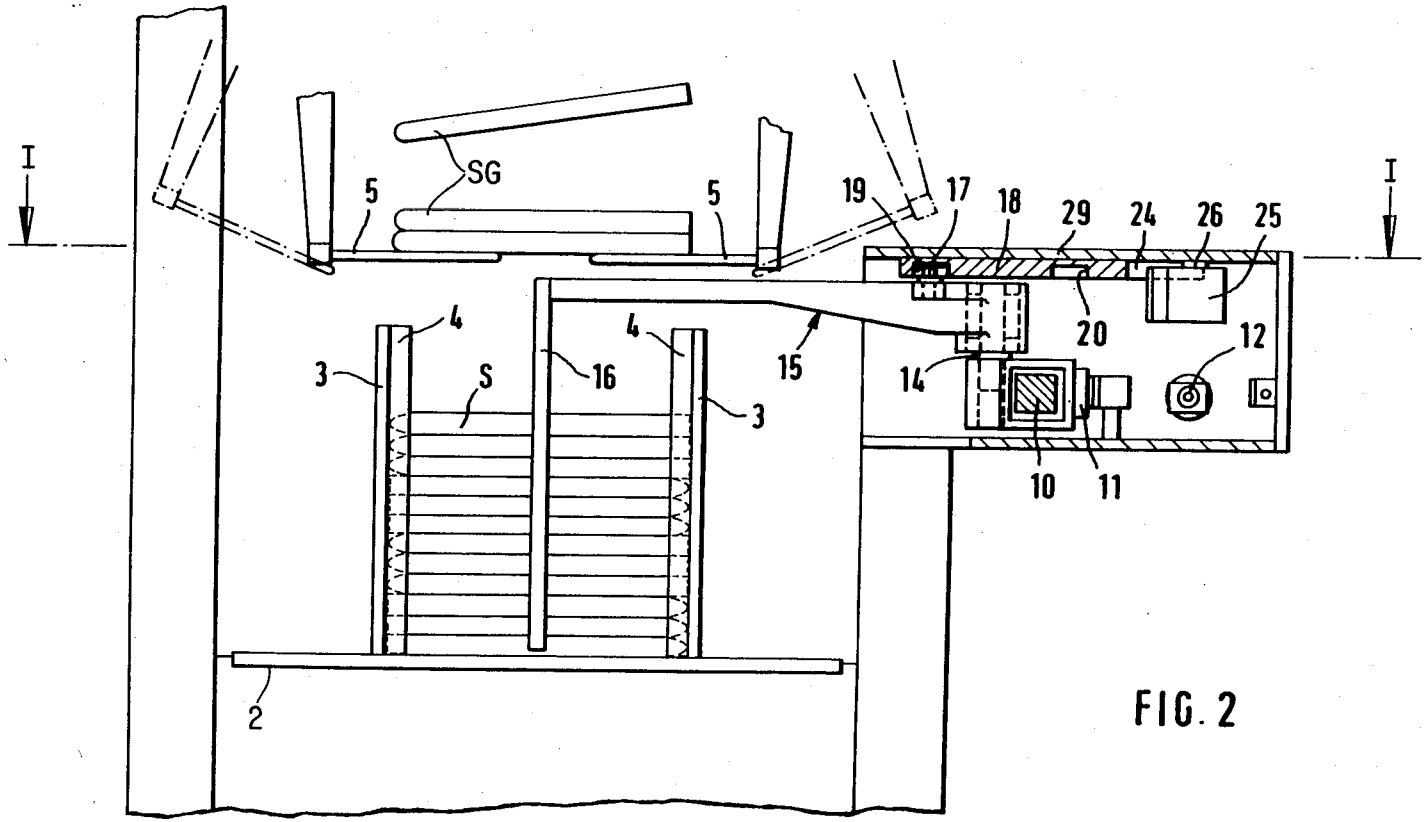
FIG. 2 is a transverse vertical sectional view as seen in the direction of arrows from the line II—II in FIG. 1, with the stack on the support omitted.

The improved apparatus comprises a stack gathering unit 1 which includes a support in the form of a turntable 2 which is indexible about a vertical axis through angles of 180° so that it can accumulate signatures SG or similar commodities constituting groups of sheets or individual sheets in orientations as shown in FIG. 2. Thus, the backs of stacks of three signatures SG each face alternately in a direction to the right and to the left, as viewed in FIG. 2. The support 2 includes or carries four upright sidewalls 3 each of which is provided with a pivotable spring-biased flap 4. The receptacle which is defined by the turntable 2, its sidewalls 3 and the flaps 4 constitutes the lower end portion of an upright duct which receives successive individual signatures SG or groups of three signatures each from a delivering unit including two gates or doors 5 (see FIG. 2) which can be moved between the solid-line and phantom-line positions in order to respectively retain or intercept successive signatures SG or groups of signatures or to permit individual signatures or groups of signatures to descend onto the upper side of the turntable 2 in the space within the confines of the sidewalls 3 and their flaps 4. The means for pivoting the gates 5 between the solid-line and phantom-line positions of FIG. 2 is not shown in the drawing because the construction and mode of operation of such pivoting means forms no part of the present invention. The construction of the stack gathering unit 1 can be similar to or identical with the construction of the corresponding unit in the aforementioned Swiss Pat. No. 496,574. The same applies for the gates 5 and for the means for pivoting the gates.

The support 2 is disposed between two stack removing conveyors 6 and 9. These conveyors are disposed opposite each other and each thereof has two halves which are mirror symmetrical to one another with reference to a vertical plane which extends through the center of a stack S on the platform 2. Such symmetry plane, as viewed in FIG. 1, extends between the two endless belts or chains 9 of the right-hand removing conveyor 9. The left-hand removing conveyor 6 of FIG. 1 can comprise a stationary platform 6' and two lateral walls 7 which define with the platform 6' a horizontal path along which the bottom sheet or signature SG of a fully grown stack S can be advanced in a direction to the left, as viewed in FIG. 1, and into the range of a hoop-casing machine 8 or another machine which processes successive stacks S.

The means for transferring stacks S from the turntable 2 onto the removing conveyor 6 or onto the removing conveyor 9 comprises a pusher 15 which is reciprocable along an elongated straight path extending at right angles to the plane of FIG. 2. The pusher 15 is a lever one arm of which carries a downwardly extending ejector 16 having two surfaces 16*a* and 16*b*. The surface 16*a* of the ejector 16 pushes a fully grown stack S from the upper side of the turntable 2, between the left-hand flaps 4 of FIG. 1, and onto the platform 6' of the removing conveyor 6 when the operator or an automatic control unit decides that successive stacks S should be transferred into the machine 8. The surface 16*b* of the ejector 16 pushes stacks S from the upper side of the turntable 2, between the right-hand pivotable flaps 4 of FIG. 1, and onto the upper reaches of the belts or chains constituting the removing conveyor 9 when the operator or the automatic control unit decides that the stacks S should be delivered onto the conveyor 9 and, by way of such conveyor, to another processing station, for example, to a second hoop-casing machine (not shown).

The apparatus comprises a stationary housing 29 which is adjacent to one side of the turntable 2 and to one side of each of the removing conveyors 6, 9. The housing 29 can be fixedly secured to the stationary part of the unit 1 and supports an elongated straight horizontal guide in the form of a rail 10 having a square, rectangular or other polygonal cross-sectional outline (see FIG. 2). The rail 10 constitutes one component of the means for reciprocating the pusher 15 along the aforementioned elongated path, and such reciprocating means further comprises a carriage 11 which is non-rotatably secured to but is slidable along the rail 10, and means for reciprocating the carriage 11 along the rail 10. The reciprocating means for the carriage 11 includes a fluid-operated (for example, pneumatic) cylinder and piston unit 12 which is mounted in the housing 29, and a suitable tackle 13 which is also installed in the housing 29 and is actuated by the piston rod of the unit 12. The rail 10 is parallel to the directions of reciprocatory movement of the pusher 15 in order to transfer stacks S from the turntable 2 onto the removing conveyor 6 or 9. The means for reciprocating the pusher 15 further comprises a shaft 14 which is provided on the carriage 11 and constitutes a means for pivotably securing the pusher to the carriage. The axis which is defined by the shaft 14 is vertical and extends at right angles to the longitudinal direction of the rail 10.

As mentioned above, one arm of the pusher 15 carries the ejector 16. The other (shorter) arm of the pusher 15 carries a roller follower 17 which forms part of a means for diverting the ejector 16 of the pusher 15 so that the ejector can bypass the turntable 2 (and more particularly that portion of the turntable which is located below the space surrounded by the sidewalls 3 and their flaps 4).

Figure 1:
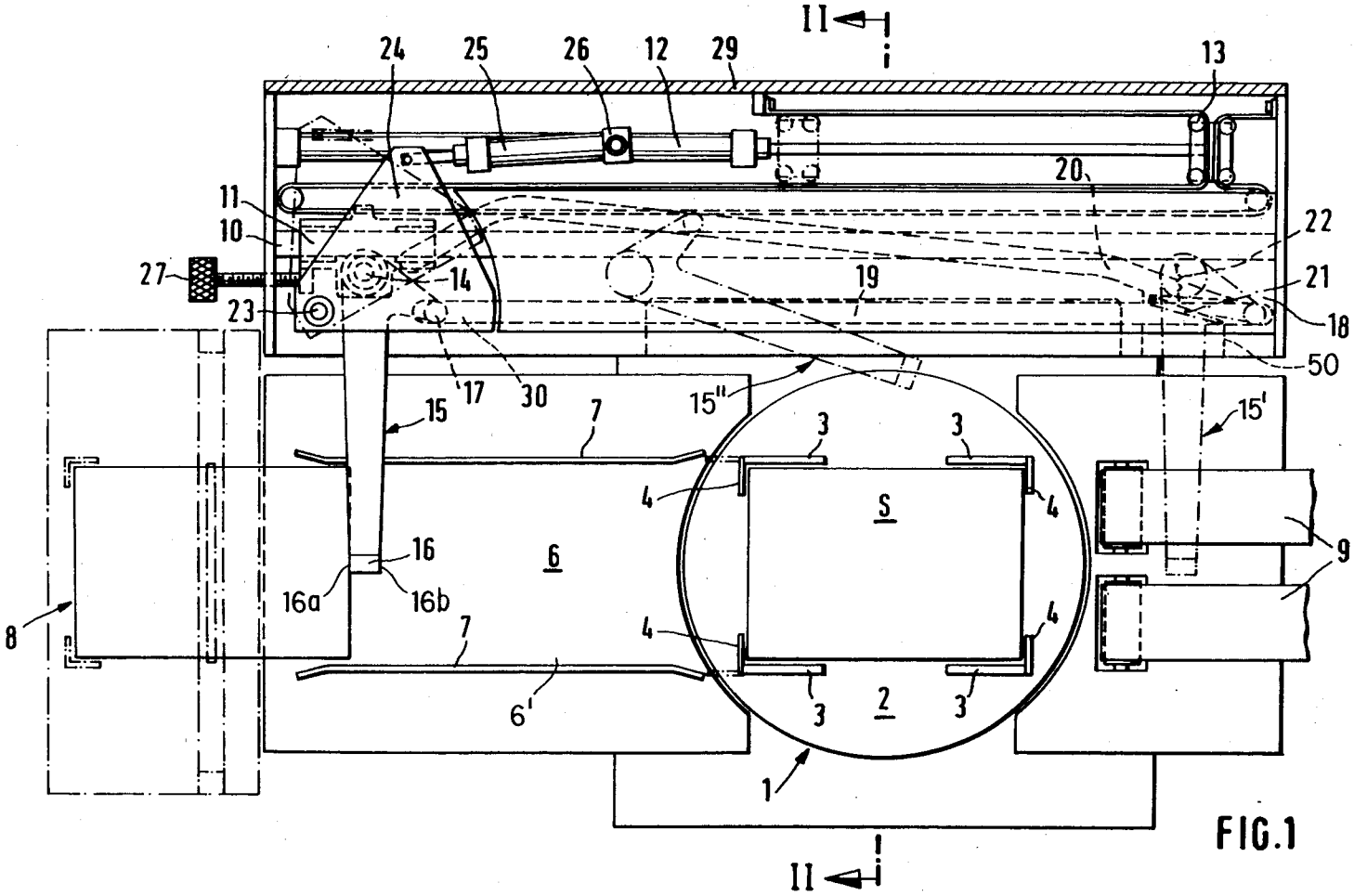
FIG. 1 is a partially plan and partially horizontal sectional view of an apparatus which embodies one form of the invention, the section being taken in the direction of arrows as seen from the line I—I in FIG. 2.

The diverting means further comprises a stationary plate-like cam 18 which is affixed to the underside of the top wall-of the housing 29 and defines for the follower 17 of the pusher 15 an elongated track including a straight first section or cam groove 19 and a curved second section or cam groove 20. The right-hand end portions of the grooves 19 and 20 are adjacent to and communicate with each other at a junction which is shown in the right-hand portion of FIG. 1 and receives a pivotable tongue-like guide 21 that is biased by a tension spring 22 so that it normally assumes the horizontal position which is indicated in FIG. 1 by broken lines. An electromagnet 50 is provided to pivot the tongue 21 against the opposition of the spring 22 to the phantom-line position of FIG. 1. The follower 17 can move from the right-hand end portion of the groove 20 into the right-hand end portion of the groove 19 by moving the tongue 21 from the horizontal to the downwardly inclined position of FIG. 1 and after the spring 22 thereupon returns the tongue 21 to the horizontal position of FIG. 1. The follower 17 can move from the right-hand end portion of the cam groove 19 into the right-hand end portion of the cam groove 20 when the electromagnet 50 is energized to pull the tongue 21 from the horizontal to the downwardly inclined position of FIG. 1 after the follower 17 reaches the right-hand end portion of the groove 19. The electromagnet 50 can be energized by remote control or by the operator who is in charge of the apparatus.

The groove 19 is parallel to the rail 10.

The tongue 21, the spring 22 and the electromagnet 50 constitute one-half of a switchover device which further comprises a plate-like cam 24 mounted on a vertical pivot 23 of the housing 29 so that it can turn about a vertical axis. The cam 24 is formed with a groove 30 (third section of the track for the follower 17) which has an open end and can register with the left-hand end portion of the groove 19 or with the left-hand end portion of the groove 20, as viewed in FIG. 1, depending on the selected angular position of the cam 24. The cam 24 can be pivoted between the two positions by a fluid-operated (for example, pneumatic) cylinder and piston unit 25 whose cylinder is articulately connected to the housing 29 by a pivot member 26 and whose piston rod is articulately connected to the adjacent portion of the cam 24. The pivotable cam 24 is adjacent to the left-hand end portion of the stationary cam 18, as viewed in FIG. 1.

The apparatus further comprises means for varying the effective length of the elongated path which is defined by the rail 10, carriage 11, unit 12 and shaft 14. The length varying means which is shown in the drawing comprises a screw 27 whose shank mates with the corresponding wall of the housing 29 and whose tip can be moved into the path of leftward movement of the carriage 11 under the action of the unit 12. By changing the axial position of the screw 27, an operator can determine the extent to which the surface 16*a* of the ejector 16 can shift a stack S from the turntable 2 onto the platform 6' of the removing conveyor 6, i.e., into the machine 8. The axis of the screw 27 is parallel to the longitudinal direction of the rail 10.

The operation of the improved apparatus is as follows:

When the gates 5 complete the accumulation of a fully grown stack S on the turntable 2, the ejector 16 of the pusher 15 is caused to perform a rightward stroke, as viewed in FIG. 1, whereby its surface 16*b* moves into and beyond the space between the left-hand flaps 14 and pushes the stack S toward and onto the belts or chains of the conveyor 9. At such time, the right-hand flaps 4 yield and permit the leading surface of the stack S to leave the confines of the sidewalls 3. The rightward movement of the pusher 15 is completed when it assumes the phantom-line position 15' shown in the right-hand portion of FIG. 1. During the last stage of its rightward movement, the follower 17 of the pusher 15 pivots the tongue 21 from the downwardly inclined to the horizontal position of FIG. 1 if the tongue 21 is held in the downwardly inclined position at the time the pusher approaches the phantom-line position of FIG. 1. If the spring 22 is free to maintain the tongue 21 in the horizontal position of FIG. 1, i.e., if the electromagnet 50 is deenergized, the follower 17 can move all the way into the right-hand end portion of the cam groove 19 without pivoting the tongue 21. The electromagnet 50 is thereupon energized to pivot the tongue 21 against the opposition of the spring 22 so that, when the carriage 11 begins to move in a direction toward the screw 27, the follower 17 is compelled to enter the right-hand end portion of the groove 20 and to pivot the ejector 16 so that the ejector bypasses the support including the turntable 2 and its sidewalls 3. This is shown in the central portion of FIG. 1 by phantom lines, as at 15″. When the follower 17 approaches the left-hand end portion of the groove 20, the groove 30 of the cam 24 slopes upwardly, as viewed in FIG. 1, so that it can receive the follower 17 before the cam 24 is pivoted by the unit 25 so that it moves its groove 30 into register with the left-hand end portion of the groove 19. Such transport of the pusher 15 by the carriage 11 in cooperation with the diverting means including the follower 17 and the cams 18 and 24 ensures that the ejector 16 bypasses the stack forming station between the sidewalls 3 so that the gates 5 can begin with the dumping of fresh signatures SG onto the upper side of the turntable 2 as soon as the ejector 16 has advanced beyond the two right-hand flaps 4 of FIG. 1.

If the apparatus is used to transfer stacks S from the turntable 2 onto the removing conveyor 6, the spring 22 is permitted to lift the tongue 21 to the horizontal position of FIG. 1 not later than when the follower 17 of the pusher 15 reaches the right-hand end portion of the groove 19, as viewed in FIG. 1. When the carriage 11 thereupon performs a leftward stroke, the follower 17 is compelled to travel along the groove 19 whereby the surface 16*a* of the ejector 16 enters the space between the right-hand flaps 4 of FIG. 1 and engages and advances the stack S against the opposition of the pivotably mounted (spring-biased) left-hand flaps 4 of FIG. 1 and onto the platform 6′ of the removing conveyor 6. When the follower 17 approaches the left-hand end of the groove 19, the groove 30 of the cam 24 is in register with the groove 19 so that the follower 17 enters the groove 30 and can be pivoted by the unit 25 about the axis of the pin 23 so that the groove 30 moves into register with the left-hand end portion of the groove 20. When the carriage 11 thereupon begins its rightward stroke, as viewed in FIG. 1, the ejector 16 bypasses the stack forming station on the turntable 2 because the pusher 15 assumes the position 15″ but the ejector 16 is compelled to return to a position for transfer of a freshly gathered stack S from the turntable 2 onto the conveyor 6 not later than when the follower 17 reaches the right-hand end of the groove 20. The just described guidance of the follower 17 ensures that the gates 5 can accumulate on the turntable 2 a fresh stack S as soon as the ejector 16 moves beyond the left-hand flaps 4 of FIG. 1.

When the follower 17 travels along the groove 20 toward the junction between the grooves 20 and 19 in the region of the tongue 21, it can depress the tongue 21 against the opposition of the spring 22 so that the follower can enter the right-hand end portion of the groove 19 whereupon the spring 22 returns the tongue 21 to the horizontal position of FIG. 1 so that the follower 17 is free to move along the groove 19 in response to renewed leftward movement of the carriage 11.

It will be seen that the improved apparatus can be converted for operation with the conveyor 6 or with the conveyor 9 by the simple expedient of energizing or deenergizing the electromagnet 50 and by appropriate pivoting of the cam 24 between the solid-line and phantom-line positions of FIG. 1. The controls for the unit 25 and electromagnet 50 can be actuated by hand or automatically in accordance with a preselected program.

An important advantage of the improved apparatus is that the gates 5 are free to accumulate or begin with the accumulation of a fresh stack S already during the second stage of movement of the ejector 16 in a direction to transfer a stack from the turntable 2 onto the conveyor 6 or onto the conveyor 9. This renders it possible to accumulate successive stacks S at a higher frequency than in conventional apparatus.

Another important advantage of the improved apparatus is that one of the conveyors 6, 9 can deliver stacks to the respective processing station when the machine at the other processing station is out of commission.

The conveyor 6 can be replaced with a conveyor having one or more endless belts or chains, driven rollers or the like. However, it is often preferred to utilize the illustrated conveyor 6 for delivery of stacks to the machine 8 because the orientation of the stacks remains unchanged as a result of continuous engagement with the surface 16*a* while the ejector 16 moves toward the solid-line position of FIG. 1 in which the stack S in front of such ejector is already located in the machine 8. The fact that the ejector 16 must transport a stack all the way into the machine 8 does not appreciably reduce the output of the improved apparatus because the formation of a fresh stack S can begin as soon as the ejector 16 advances beyond the left-hand flaps 4 of FIG. 1.

Without further analysis, the foregoing will so fully reveal the gist of the present invention that others can, by applying current knowledge, readily adapt it to various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating sheet-like commodities, particularly stacks of paper sheets, comprising a support; means for delivering to said support a succession of commodities along a first path; first and second conveyors disposed at the opposite sides of said support; a pusher for transferring commodities from said support to a selected conveyor; means for reciprocating said pusher between first and second positions along a predetermined path wherein the pusher advances from said first toward said second position to transfer a commodity from said support onto said first conveyor and from said second toward said first position to transfer a commodity from said support onto said second conveyor; and means for selectively diverting said pusher during advancement from at least one of said positions toward the other of said positions so that the pusher is prevented from intersecting said first path.

2. The apparatus of claim 1, wherein said pusher has a first surface which engages and moves a commodity during movement of the pusher from said first toward said second position and a second surface which engages and moves a commodity during movement of the pusher from said second toward said first position.

3. The apparatus of claim 1, wherein said diverting means comprises means for diverting said pusher during advancement from said first toward said second position, or vice versa.

4. The apparatus of claim 1, wherein said reciprocating means comprises an elongated guide, a carriage which is reciprocable along said guide, means for moving said carriage relative to said guide, and means for pivotably securing said pusher to said carriage, said diverting means comprising means for pivoting said pusher relative to said carriage.

5. The apparatus of claim 4, wherein said said predetermined path is an elongated straight path and said securing means defines for said pusher a pivot axis which is substantially normal to said predetermined path.

6. The apparatus of claim 5, wherein said predetermined path is substantially horizontal and said axis is substantially vertical.

7. The apparatus of claim 4, wherein said pivoting means comprises a follower provided on said pusher and cam means tracked by said follower.

8. The apparatus of claim 7, wherein said cam means includes a first section which is tracked by said follower while said pusher advances along said predetermined path without bypassing said first path and a second section section which is engaged by said follower while said pusher is diverted so that it bypasses said first path support.

9. The apparatus of claim 8, wherein said diverting means further comprises switchover means operable to engage-said follower with said second section after the follower completes its advancement toward said one position.

10. The apparatus of claim 9, wherein said sections have neighboring first and neighboring second end portions and said switchover means includes a device for transferring said follower from engagement with the first end portion of said first section into engagement with the first end portion of said second section or vice versa.

11. The apparatus of claim 10, wherein said device comprises second cam means having a third cam section and means for moving said second cam means between a first position in which said third section registers with the first end portion of said first section and a second position in which said third section registers with the first end portion of said second section.

12. The apparatus of claim 10, wherein said switchover means further comprises a guide and means for moving said guide between a first position in which the follower is free to move only from the second end portion of said first section toward engagement with the second end portion of said second section and a second position in which said follower can move only from the second end portion of said second section toward engagement with the second end portion of said first section.

13. The apparatus of claim 12, wherein the means for moving said guide comprises an electromagnet which is energizable to maintain said guide in one of said positions.

14. The apparatus of claim 1, further comprising means for varying the effective length of said predetermined path.

15. The apparatus of claim 14, wherein said predetermined path is elongated and includes a first end and a second end, said varying means including a stop which is movable into and relative to one end of said predetermined path to thereby determine the respective position of said pusher.

16. Apparatus for manipulating sheet-like commodities, particularly stacks of paper sheets, comprising a support; means for delivering to said support a succession of commodities along a first path; a conveyor adjacent to said support; a pusher for transferring commodities from said support to said conveyor; means for reciprocating said pusher between first and second positions along a predetermined path wherein the pusher advances from said first to said second position to transfer a commodity from said support onto said conveyor; and means for diverting said pusher during advancement of the pusher from said second toward said first position so that the pusher is prevented from intersecting said first path.

17. The apparatus of claim 16, wherein said reciprocating means includes an elongated guide, a carriage which is reciprocable along said guide, means for moving said carriage relative to said guide, and means for pivotably securing said pusher to said carriage, said diverting means comprising means for pivoting said pusher relative to said carriage.

18. The apparatus of claim 17, wherein said pivoting means comprises a follower provided on said pusher and cam means tracked by said follower.

19. The apparatus of claim 16, further comprising means for varying the effective length of said predetermined path.

* * * * *